US007398709B2

(12) United States Patent
Vitrac et al.

(10) Patent No.: US 7,398,709 B2
(45) Date of Patent: Jul. 15, 2008

(54) CORK EXTRACTOR

(75) Inventors: Jean-Pierre Vitrac, Paris (FR); Stephane de Bergen, Villecerf (FR)

(73) Assignee: Le Creuset, S.A. (FR)

( * ) Notice: Subject to any disclaimer, the term of this patent is extended or adjusted under 35 U.S.C. 154(b) by 0 days.

(21) Appl. No.: 10/570,635

(22) PCT Filed: Aug. 16, 2004

(86) PCT No.: PCT/IB2004/002794

§ 371 (c)(1),
(2), (4) Date: Dec. 28, 2006

(87) PCT Pub. No.: WO2005/023696

PCT Pub. Date: Mar. 17, 2005

(65) Prior Publication Data

US 2007/0089570 A1 Apr. 26, 2007

(30) Foreign Application Priority Data

Sep. 4, 2003 (GB) ..... 0320766.9

(51) Int. Cl.
*B67B 7/62* (2006.01)
*B67B 7/00* (2006.01)

(52) U.S. Cl. ..... 81/3.37; 81/3.45

(58) Field of Classification Search ..... 81/3.07, 81/3.27, 3.29, 3.37, 3.45
See application file for complete search history.

(56) References Cited

U.S. PATENT DOCUMENTS 5,934,160 A 8/1999 Gibson et al.

FOREIGN PATENT DOCUMENTS

DE 20219538 3/2003
GB 2399566 A 9/2004

*Primary Examiner*—David B Thomas
(74) *Attorney, Agent, or Firm*—Gary L. Bush; Andrews Kurth LLP

(57) ABSTRACT

Apparatus for extracting a cork from a bottle comprises a corkscrew mounted in a carrier, the carrier being mounted on a frame for longitudinal reciprocating movement with respect to the longitudinal axis of the corkscrew and the corkscrew being rotatably mounted on the carrier for joint longitudinal movement therewith, the axis of rotation of the corkscrew being generally coincident with the centre line of the corkscrew. A control nut is rotatably mounted on the frame, the control nut having a screw passage therethrough, the screw passage being positioned to receive the corkscrew and configured to mate with the configuration of the corkscrew whereby, upon longitudinal movement of the corkscrew in the screw passage, rotational movement is imparted to the corkscrew. Actuator means is operatively connected to the carrier for reciprocating the carrier. The apparatus includes first restraint means independent of the control nut for restraining rotation of the corkscrew with respect to the carrier, second restraint means for restraining rotation of the control nut with respect to the frame and latch means for releasably latching the control nut to the frame to restrain relative movement therebetween in the longitudinal direction with respect to the longitudinal axis of the corkscrew. The first and/or second restrain means comprises a detent on the part whose rotation is to be restrained and a recess for receiving the detent when rotation of the part is to be restrained.

16 Claims, 12 Drawing Sheets

CORK EXTRACTOR

This invention relates to a device for extracting corks from bottles of wine and the like.

Various types of devices are known for extracting corks from bottles of wine and the like. Of these, the best known is probably the simple corkscrew usually provided with an integral handle. Whilst such devices have the advantage of small size they do not always operate satisfactorily, as a relatively high degree of skill and expertise is required to keep the corkscrew properly aligned and centred as it is driven into a cork.

Consequently, numerous more elaborate types of devices have been developed. Amongst the objectives sought in the design-of such devices are: speed of operation, reduction in the force which must be exerted by the user to drive the screw into the cork and/or to pull the cork from the bottle positive and accurate alignment of the screw with respect to the cork, and removal of the cork Without breakage.

One type of cork extracting apparatus which has been developed in response to the above needs has a corkscrew mounted on a carrier which in turn is mounted for longitudinal reciprocation with respect to a frame. As the carrier and corkscrew are moved by a suitable actuator such as a handle, the corkscrew is driven through a mating screw passage in a control nut. During this movement, the control nut is restrained against both longitudinal and rotational movement with respect to the frame so that the corkscrew is caused to rotate on movement through the screw passage. Thus, the corkscrew may be driven into the cork in a bottle which is positioned below the control nut. Subsequently the carrier and corkscrew are retracted upwardly by further movement of the actuator. At this time the control nut is still restrained against rotational movement with respect to the frame but is permitted to move longitudinally with the carrier and corkscrew. Thus, the corkscrew is drawn upwardly without rotation and so extracts the cork from the bottle.

Most such devices further provide for stripping the extracted cork from the screw. This is generally achieved by using the actuator to lower the carrier, corkscrew and control nut. When the control nut returns to its original position, it is once again restrained against longitudinal movement with respect to the frame. Then, as the carrier is raised a second time, the corkscrew is moved through the control nut and caused to rotate in a reverse direction and thereby be removed tom the cork.

However, problems arise with apparatus of this type, primarily from the fact that for one complete operation the carrier is reciprocated downwardly and back upwardly twice along the same path. Furthermore, during the first upward movement of the carrier, the control nut must be free to move upwardly with the corkscrew so that the cork can be extracted from the bottle but during the second upward movement of the carrier the nut must be fixed longitudinally with respect to the frame so that the corkscrew can be backed out of the cork.

It is known to provide a camming mechanism or the like which automatically alternately latches and unlatches the control nut during successive upward movements of the carrier. However, such arrangements are unsatisfactory in that they are generally relatively complicated mechanically which is not only undesirable in and of itself but further tends to increase the overall bulk and weight of the device. Furthermore, with such automatic latch mechanisms any movement of the actuator when the apparatus is not actually being employed to remove a cork can cause the latch mechanism to be inadvertently engaged or disengaged.

A significant improvement in cork extracting apparatus of this type is disclosed in British Patent 2053867. The cork extractor disclosed in that Patent has latch means which is released by cooperation between a bottle-engaging assembly and a bottle from which the cork is to be extracted. As a result of this and because the latch means operates independently of the force of gravity it is virtually impossible for the latch means to be released and the control nut displaced by accident. Rather release of the latch means requires a positive and deliberate action on the part of the user, that is, engagement of a bottle neck with the bottle engaging assembly. Since such an action can hardly be accomplished inadvertently, the release mechanism is virtually foolproof.

However, the cork extractor of British Patent 2053867 whilst overcoming many of the problems associated with prior extractors of the same type and having been a significant commercial success still suffers from a number of disadvantages.

The cork extractor includes means for positively restricting rotation of the corkscrew as a cork is being pulled from a bottle to ensure that the cork is indeed pulled, rather than the corkscrew backing out of the cork. Whilst the provision of such means is.,advantageous, the proposed form for the means has been found to have deficiencies in practice. The British Patent suggests means which interlock the control nut and the corkscrew during the pulling stroke, the means taking the form of a bore of the control nut which frictionally binds with a rod secured to the carrier. This arrangement however, suffers from the deficiency that it is not always effective, particularly when the cork is made of plastic. The commercial embodiment of the cork extractor of British Patent 2053867 has, as a result, not been wholly successful in dealing with plastic corks, the use of which is becoming increasingly prevalent Another reason why the cork extractor of British Patent 2053867 and others of the same type do not deal successfully with plastic corks is because of the way in which an extracted cork is stripped from the corkscrew. As set out above, this is achieved by restraining the control nut against longitudinal movement and then raising the carrier to cause the corkscrew to move through the control nut and rotate in a reverse direction. As the corkscrew is raised and turns inside the static control nut for applies a rotational and also translational force on the cork. When the cork contacts the static control nut it is pressed against it. With a synthetic cork, this results in compression of the cork which therefore grips the corkscrew. This makes it difficult to extract the corkscrew from the cork.

Another problem with the cork extractor of British Patent 2053867 is the form of the bottle engaging assembly which in both the preferred embodiment of the Patent and in the commercial embodiment comprises two clamp members extending generally transversely to the longitudinal axis of the corkscrew. The clamp members significantly increase the overall dimensions of the cork extractor and make it difficult to store.

The British Patent discloses a number of possible forms for the actuator means but in the commercial embodiment none of these are employed. Instead in the commercial embodiment, the actuator means comprises a rack formed on an elongate movable drive member connected to the carrier and longitudinally slidably mounted in the frame and a pinion having teeth engaged with those of the rack and mounted on the frame such as to be rotatable about an axis generally transverse to that of the corkscrew and so cause longitudinal sliding of the rack relative to the frame. Whilst a rack and pinion is a very efficient form for the actuator means, the arrangement with a movable rack and fixed pinion increases the dimensions of the cork extractor in the longitudinal direction in use which gives it a rather unwieldy appearance Generally, the cork extractor of British Patent 2053867 is quite complex having a large number of parts. Furthermore, the commercial embodiment is relatively sizable with protruding elements such as the clamp arms, which makes it difficult to store. It does not present a neat appearance either when stored or in use.

A further deficiency of the cork extractor of British Patent 2053867 is that two complete reciprocations of the carrier is required for cork extraction and then stripping of the cork from the corkscrew. To put it another way, six steps are generally required for a complete operation of cork exactor and cork removal. These six steps are:.

1. Raise carrier and corkscrew above the frame to allow positioning of a bottle relative the frame.
2. Lower carrier and corkscrew to drive corkscrew into cork.
3. Raise carrier, control nut and corkscrew to extract cork from bottle.
4. Lower carrier, control nut and corkscrew to relatch the control nut.
5. Raise carrier and corkscrew to strip cork from the corkscrew.
6. Lower carrier and corkscrew to initial position.

Furthermore between steps 3 and 4, the cork extractor must be disengaged from the bottle or the cork will simply be drive back into the bottle It is an object of the present invention to provide a cork extractor of the type discussed above which overcomes one or more of the deficiences of the cork extractor of British Patent 2053867.

The invention provides an apparatus for extracting a cork from a bottle which, like that of British Patent 2053867, comprises a corkscrew mounted on a carrier, the carrier being mounted on a frame for longitudinal reciprocating movement with respect to the longitudinal axis of the corkscrew and the corkscrew being rotatably mounted on the carrier for joint longitudinal movement therewith, the axis of rotation of the corkscrew being generally coincident with the centre line of the corkscrew, a control nut having a screw passage therethrough, the screw passage being positioned to receive the corkscrew and configured to mate with the configuration of the corkscrew whereby, upon longitudinal movement of the corkscrew in the screw passage, rotational movement is imparted to the corkscrew, actuator means operatively connected to the carder for reciprocating the carder and latch means for releasably latching the control nut to the frame to restrain relative movement therebetween in the longitudinal direction with respect to the longitudinal axis of the corkscrew.

In accordance with a first aspect of the invention, the control nut is rotatable mounted on the frame and the apparatus further comprises first restraint means independent of the control nut for restraining rotation of the corkscrew with respect to the carrier and second restraint means for restraining rotation of the control nut with respect to the frame, the first and/or the second restraint means comprising a detent on the part whose rotation is to be restrained and a recess for receiving the detent when rotation of the part is to be restrained.

The apparatus differs from that of British Patent 2053867 in that the means for restraining the corkscrew against rotation is independent of the control nut. This obviates the need for a frictional binding arrangement of the type disclosed in the British Patent. The apparatus further differs from that of the British Patent in that the control nut is rotatably mounted on the frame which-allows the control nut to be employed to strip a cork off the corkscrew. However, to ensure that the control nut still functions properly in pulling of a cork from a bottle, the apparatus includes second resin meat* for restraining the control nut against rotation.

The advantage of enabling the control nut to be employed to strip a cork off the corkscrew is that compression of the cork and so gripping of the corkscrew by the cork can be prevented which means that the cork extractor can function effectively even with synthetic corks.

The provision of the first and/or the second restraint means, preferably both, as a detent and a cooperating ensures to the is property applied by positive engagement rather than by, for example, frictional binding. There is no risk of slippage between the parts which could prevent the corkscrew from rotating during cork extraction and therefore prevent cork extraction from being properly accomplished.

The first restraint means may comprise at least on detect carried by the corkscrew and a cooperating recess provided in the carrier. Suitably the corkscrew has a screw head by which it is mounted in the carrier and the detent is provided on the screw head. The carrier may dent a chamber for receiving the screw head, the chamber including an upper wall a lower wall and an aperture in the lower wall through which the core extends and being sized to allow restricted movement of the screw head therein in the longitudinal direction, the recess being defined in the lower wail adjacent the aperture and a bearing being held between the upper wail and the screw head.

This arrangement has been found to be very effective in both positively restraining the corkscrew against rotation when required and also ensuring the proper rotation of the corkscrew occurs at the appropriate times during operation of the apparatus. In addition to effectiveness, the arrangement has the advantage of a relatively shall number of parts which a can readily be manufactured so making it economical both in terms of size and cost.

The second restraint member may comprises at least one detent carried by the control nut and a cooperating recess. The recess can be provided in the frame or in a control nut holder fixed to the frame. The advantage of the former is reduction. In the number of parts required whilst the advantage of the latter is simplicity of frame manufacture.

Very preferably, the first and/or the second restraint means comprises a plurality of recesses arranged generally in a circle. This means that no matter the orientation of the corkscrew and/or control nut the restraint means will function.

As set out above, a holder may be provided for the control nut and-this may be arranged to allow restricted movement of the control nut with respect thereto in the longitudinal direction between an upper position in which the control nut can rotate relative the frame and a lower position in which rotation of the control nut is restrained by the second restraint means. The control nut holder can comprise two members which, when engaged, define a chamber for receiving a section of the control nut, the chamber being sized to allow said restricted movement of the control nut This arrangement has similar advantages to those of the preferred arrangement of the carrier and corkscrew.

Preferably the control nut holder is also arranged to permit limited tilting of the control nut it has been found that this can be of advantage in successful pulling of plastic corks.

In accordance with another aspect of the invention, the actuator comprises a rack secured to the frame and a pinion engaged with the rack and movable relative to the rack and the frame, the carrier being mounted on the frame via the pinion and rack.

This aspect, which is preferably but not necessarily combined with the first aspect, gives great advantages in terms of the aesthetic appearance of the apparatus whilst still retaining the effective drive produced by a rack and pinion. Provision of a fixed rack and a movable pinion allows reduction of the size of the apparatus overall and improved storage capabilities.

More particularly, it has been found that a fixed rack and movable pinion permits a smoother, more ergonomic movement by a user when extracting a cork and also stripping the cork from the cork extractor. In addition, there is less friction between the rack, pinion and frame which means that less effort is required for cork extraction.

Furthermore, use of a fixed rack and a movable pinion gives more scope for varying the appearance of the-drive of the cork extractor.

The actuator may further comprise a lever for rotating the pinion to cause movement of the pinion relative the rack. A lever is preferred as giving the greatest mechanical advantage and therefore facilitating use of the corkscrew even by those without great strength.

The rack may be integral with :the frame or separately formed therefrom. The advantage of the former is: reduction in the number of parts whilst the advantage of the latter is that the actuator may be provided as a module including the carrier and corkscrew.

In accordance with a third aspect of the invention, the latch means comprises a detent mounted such as to be movable between a first latching, position and a second, release, position and bottle-engaging means which, when engaged by a bottle, cause movement of the latch from the first to the second position. To some extent this is similar to the apparatus of British Patent 2053867 but in the preferred embodiment, the bottle-engaging means comprises a lever engagable with a bottle neck. The lever is connected to the detent such that, on engagement with the bottle neck it causes pivoting of the detent. This preferred embodiment therefore does away with the unwieldy clamp arms of the British Patent instead the latch means take an elegantly simple form which has been found to be very effective in practice.

The detent may be pivotally mounted to the frame or it can form part of an actuator module.

frame may comprise a sleeve extending in the longitudinal direction and enclosing the corkscrew, the carrier, the control nut and the latch means. This has advantages in terms of neatness of appearance and ease of storage of the apparatus.

Overall the invention provides an improved cork extractor which is simple in construction, effective in operation and aesthetically pleasing.

The invention will now be further described by way of example with reference to the accompanying drawings in which:

FIGS. 7A to 71 are sectional views illustrating the operation of the apparatus of FIG. 1;.

Figure 1:
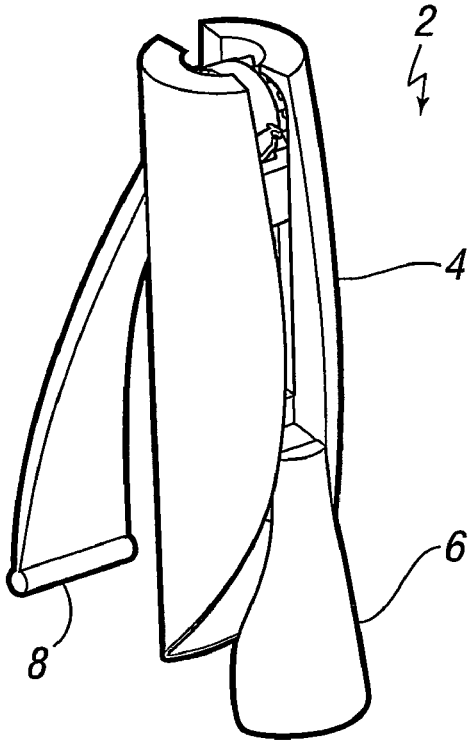
FIG. 1 is a prospective view of an apparatus in accordance with the invention.

The cork extractor 2 shown in FIG. 1 comprises a frame 4, a handle 6 and a lever 8. It is noted that only the-handle 6 and lever 8 protrude from the frame 4 but the handle 6 generally follows the lines of the frame 4 such that overall the cork extractor 2 has a "clean" and aesthetically pleasing appearance and has a relatively compact cross-section which makes it readily storable.

Contained within the frame 4 are a screw and carrier assembly 10, a control nut assembly 12 and a latch assembly 14. The fact that all these assemblies are held within the frame 4 leads to the pleasing appearance and ready storability discussed above.

Figure 2:
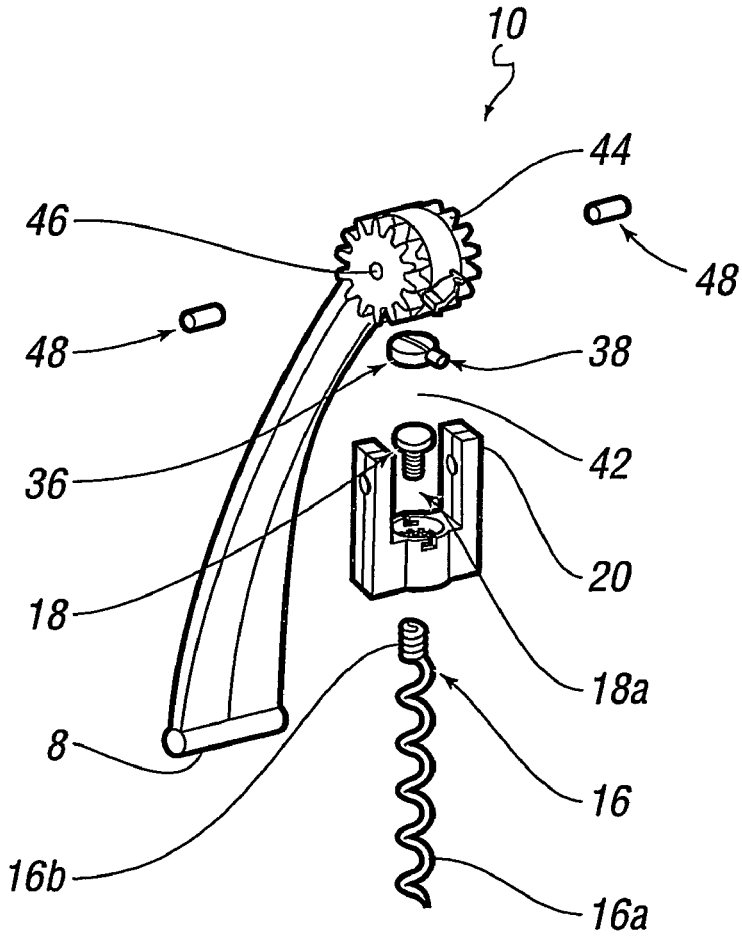
FIG. 2 is an exploded view showing a first assembly of the apparatus of FIG. 1.
Figure 3:
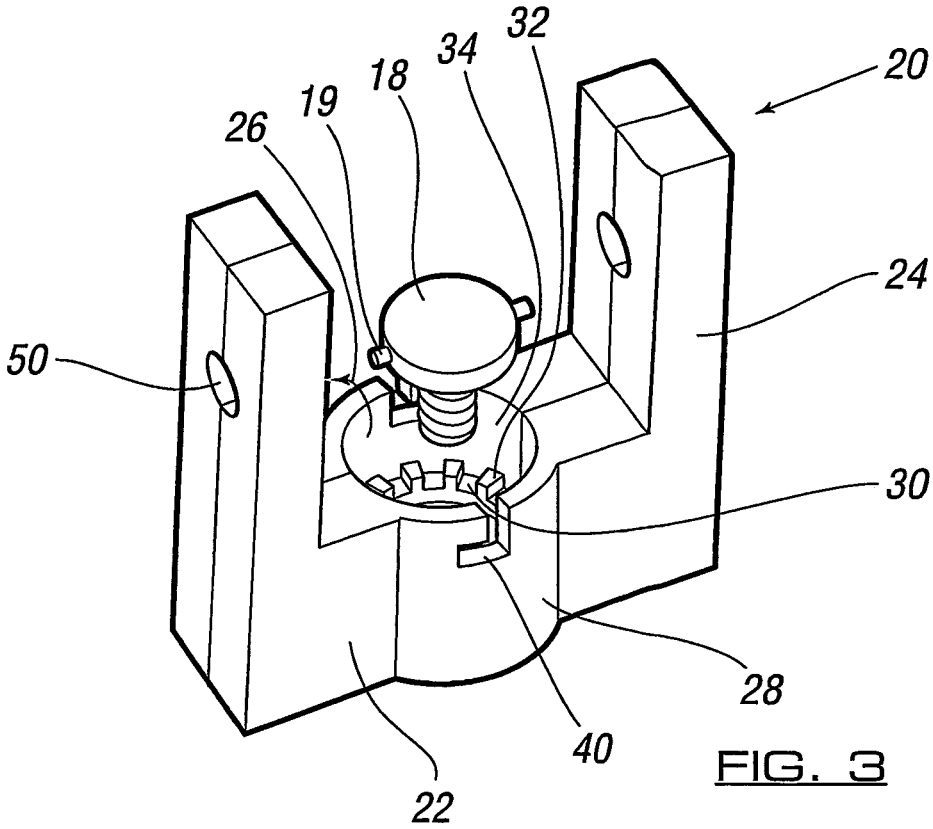
FIG. 3 is a prospective view illustrating the arrangement of parts of the assembly of FIG. 2.

The screw and carrier assembly 10 is illustrated in FIGS. 2 and 3. This comprises a corkscrew 16 which includes a lower cork-engaging portion 16*a* and an upper connection portion 16*b*. The lower portion 16*a* has a relatively large pitch helix whilst the upper portion 16*b* is wound into a much tighter or smaller pitch helix by which the corkscrew 16 is attached to a screw head 18. The screw head 18 includes a downwardly extending stud portion 18*a* having external threads formed thereon. The threads of stud portion 18*a*are sized and configured so that the stud portion 18*a* can be threaded into the tightly wound upper connection portion 16*b* of the corkscrew 16. This method of mounting the corkscrew 16 on the screw head 18 forms a dutch mechanism whereby when the apparatus is fully assembled, attempted rotation of the lower corkscrew portion 16*a* in a direction which would tend to unthread upper portion 16*b* from stud portion 18*a* of screw head 18 would simply cause connection portion 16*b* of the corkscrew 16 to tighten about and more firmly grip stud portion 18*a* thereby preventing such unthreading. Thus, accidental disconnection of the two is virtually precluded.

The screw head 18 has two pins 19 extending from opposite sides thereof which constitute a first part of restraint means for restraining rotation of the corkscrew 16. The second part of the restraint means is provided in the carrier 20 as further discussed below.

The carrier 20 has a main body portion 22 with upwardly extending arms 24 on either side thereof. The main body portion 22 is formed with a cavity 26 terminating in an, aperture 28 sized for passage of the lower cork engaging portion 16*a* of the corkscrew 16. The aperture 28 has a smaller diameter than the cavity 26 with the result that a step 30 is formed therebetween. The step 30 has upstanding teeth 32 circumferentially spaced therearound to define a plurality of recesses 34 therebetween. The recesses 34 are sized to receive the pins 19 of the screw head 18 and constitute a second part of restraint means for restraining rotation of the corkscrew 16.

The corkscrew 16 is mounted on the carrier 20 by feeding the lower cork-engaging portion 16*a* through the aperture 28 of the carrier 20 to locate the screw head 18 in the cavity 26 with the pins engaged in one opposite pair of recesses 34. The cavity 26 is then closed by a screw retainer 36 which is secured to the carrier 20 by a bayonet fitting, pins 38 on the retainer 36 being received in bayonet slots 40 formed tin the upper portion of the walls of the carrier main body portion 22 around the cavity 26. As illustrated in FIG. 2, a ball bearing 42 is trapped between the screw head 18 and the retainer 36 which allows rotation of the corkscrew 16 relative the carrier 20 when the corkscrew 16 is not restrained against rotation.

FIG. 2 also illustrates that the lever 8 includes two pinions 44 on either side of its head, the pinions 44 both having a central aperture 46. The lever 8 is mounted to the carrier 20 by insertion of lever pins 48 through apertures 50 in the arms 24 of carrier 20 and the apertures 46 of the pinions 44. The lever pins 48 serve to mount the lever 8 to the carrier 20 such that the lever 8 is rotatable around an axis defined by the lever pins 48.

Figure 4:
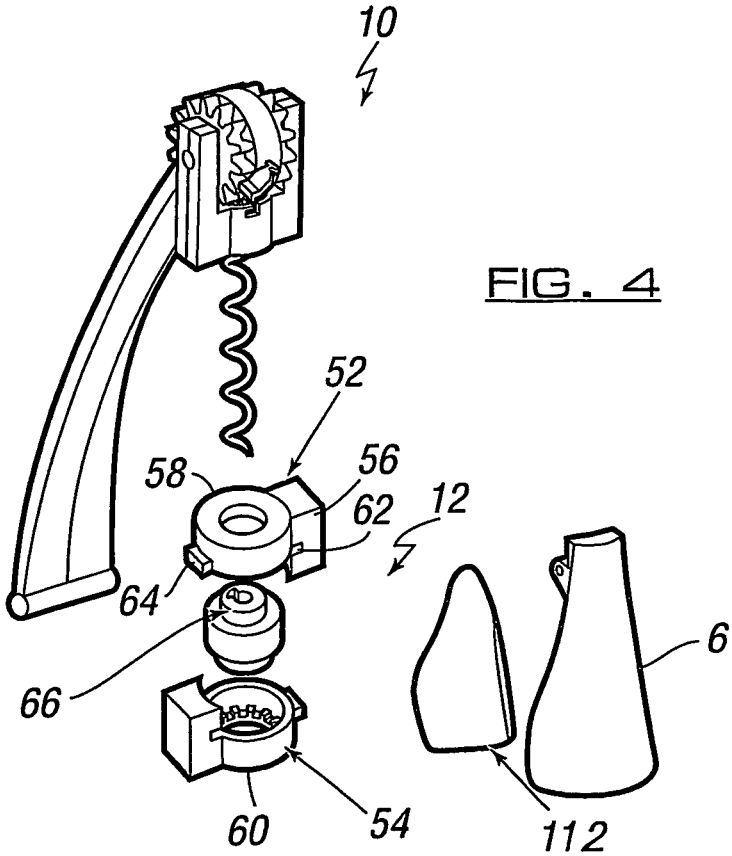
FIG. 4 is an exploded view showing a second assembly of the apparatus of FIG. 1.

The completed screw and carrier assembly 10 is illustrated in FIG. 4. That figure also illustrates the control nut assembly 12 which comprises a holder formed from an upper holder member 52 and a lower holder member 54. The upper and lower holder-members 52 and 54 both comprise an arm 56 which carries a holder: ring 58, 60. The arms 56 are formed with slots 62 for receiving bosses 64 carried on the rings 58, 60 to engage the upper and lower holder, members 52, 54 and trap a control nut 66 therebetween.

Figure 5A:
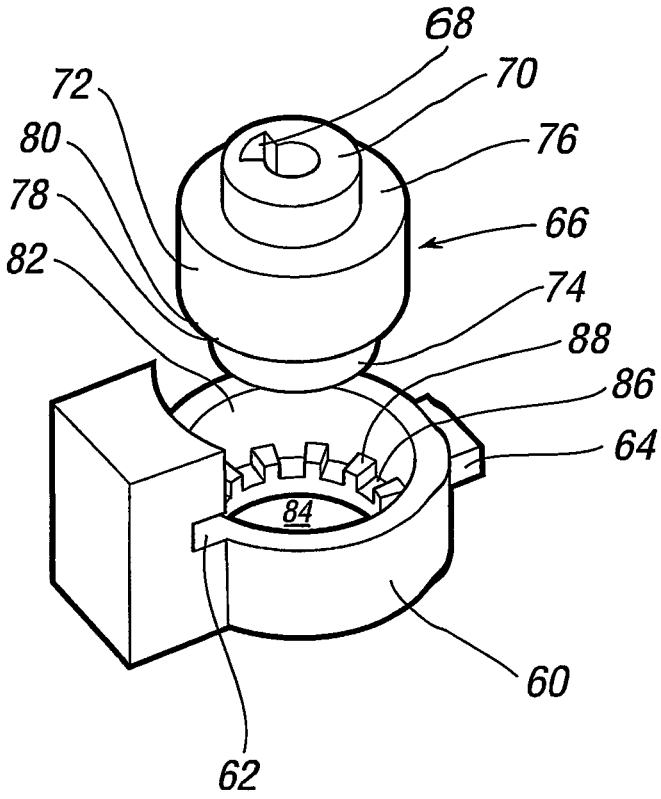
FIG. 5A is a first prospective view illustrating parts of the assembly of FIG. 4.

As shown in FIG. 5A, the control nut 66 has a helical screw passage 68 sized and configured to mate with the cork-engaging portion 16*a* of corkscrew 16. The helical screw passage 68 extends through the three regions 70, 72 and 74 into which the control nut 66 is divided by forming these regions 70, 72 and 74 of different diameters. The upper and lower regions 70, 74 have smaller diameters than the middle region 72 with the result that a step 76, 78 is formed between the upper and lower regions 70, 74 and the middle region 72. The lower step 78 Is formed with a plurality of protruding teeth 80 which constitute a first part of restraining means for restraining rotation of the control nut 66 relative the control nut holder 52, 54.

The ring 60 of the lower control nut holder member 64 has a somewhat similar form to the body portion 22 of the carrier in that it includes a cavity 82 terminating in an aperture 84 of smaller diameter to thereby provide a step 88 around,the aperture 84. The step 88 has a series of teeth 88 definition recesses therebetween which constitute a second part of the means for restraining the control nut 66 against rotation. When Fe control nut holder is assembled with the control nut 66 therein, gravity will cause the teeth 78 on the control nut 66 to engage in the recesses between the teeth 88 of the ring 60 of the lower control nut holder member 54.

Figure 5B:
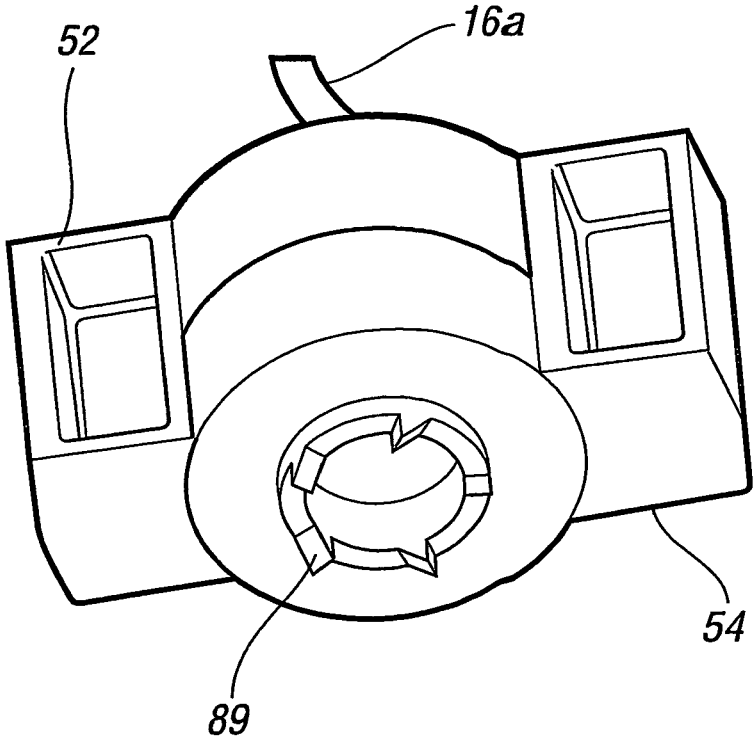
FIG. 5B is a second perspective view showing parts of the second assembly.
Figure 7A:
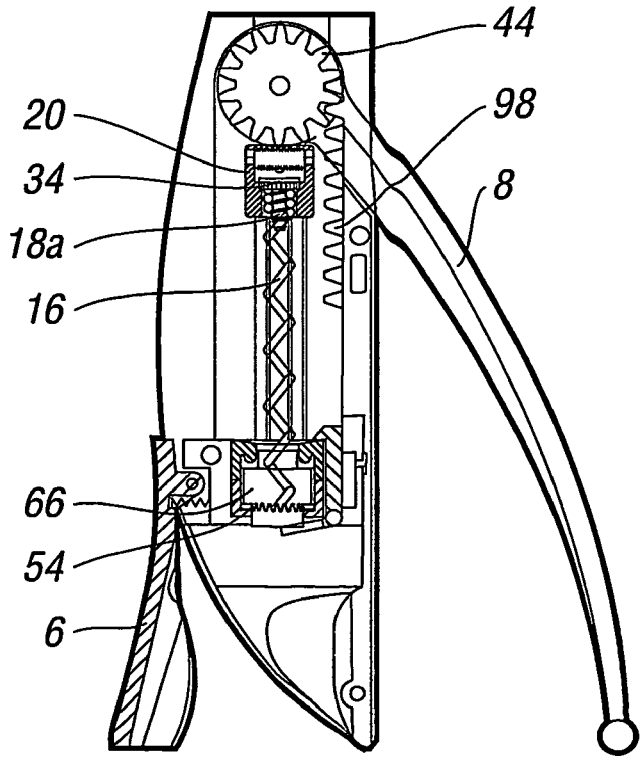
Figure 7B:
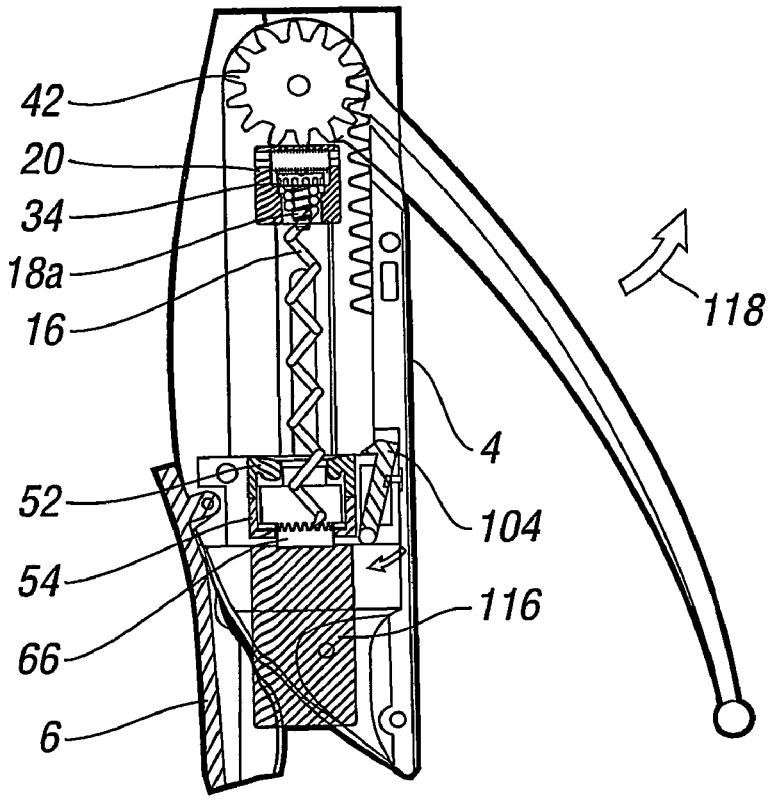
Figure 7C:
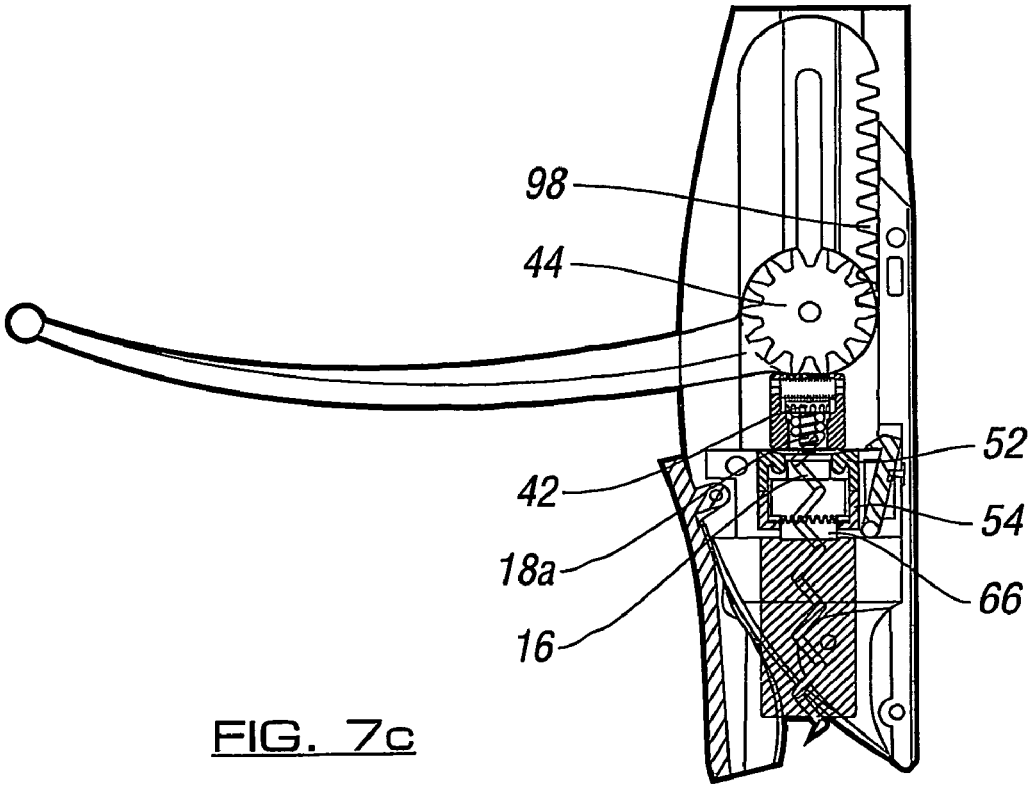

FIG. 5B shows the control nut assembly 12 in its assembled form. Referring now to FIG. 7E, it will be seen that when the control nut assembly 12 is in its assembled form, the rings 58, 60 of the upper and lower control nut holder members 52, 54 define a chamber which receives the middle section 72 of the control nut 66 in a relatively close fit widthways but with some play lengthways. The lengthways play is limited by annular flange 58*a* of the ring 58 of the upper control nut holder member 52 and annular flange 60*a* of the ring. 60 of the lower control nut holder member 54. The upper annular flange 58*a* receives the upper section 70 of the control nut 66 in a reasonably close fit whilst the lower annular flange 60*a* defines the aperture 84 and provides the step 86.

FIG. 5B also shows the cork-engaging portion 16A of corkscrew 16 engaged with the helical screw passage 68 of the control nut assembly 12 and serves to illustrate that the lower region 74 of the control nut 66 which protrudes through aperture 84 is formed on its lower face with teeth 89. The purpose of the teeth 89 will be described further below.

Figure 6:
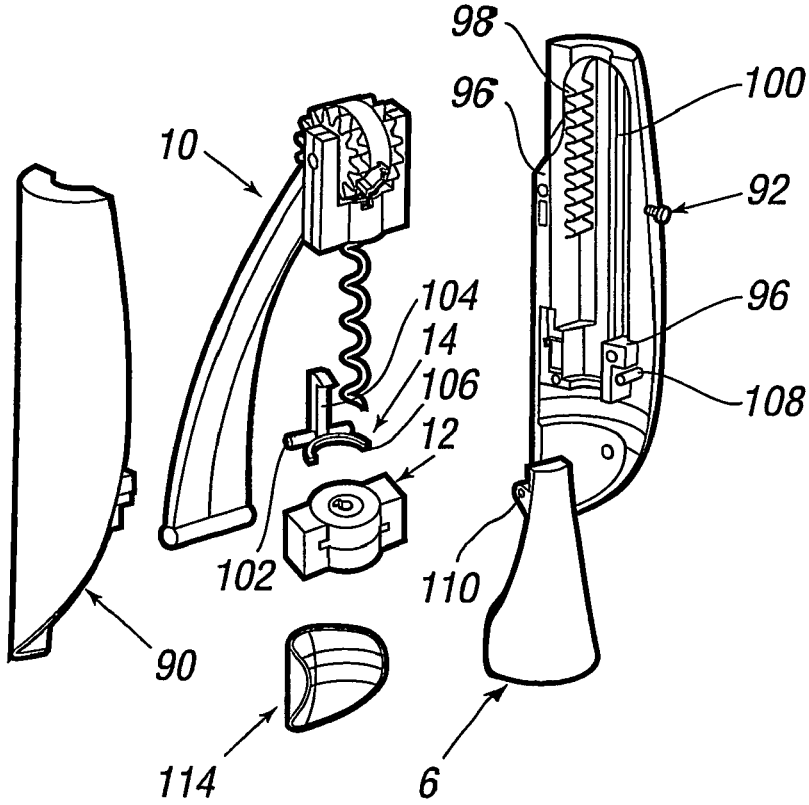
FIG. 6 is an exploded view showing a third assembly of the apparatus of FIG. 1.

FIG. 6 shows the control nut assembly 12 Is in its assembled form. It further illustrates that the frame 4 Is formed from two halves 90, 92 which are connected together by pins (not shown) which engage in apertured bosses 96. Each frame half 90, 92 Is formed with a rack 98 and a channel 100 extending generally parallel to the rack 98. The channel 100 are dimensioned to receive the arms 56 of the control nut assembly 12 when the frame halves 90, 92 are connected together with the control nut assembly 12 therebetween. The channels 100 retain the control nut assembly 12 in the frame 4 but allow sliding movement of the control nut assembly 12 generally parallel to the racks 98.

The corkscrew and carrier assembly 10 is also retained within the frame when the frame halves 90, 92 are connected by engagement of the teeth of the pinions 44 with those of the racks 98. The latch assembly 14 is retained within the frame when the frame halves 90, 92 are connected, in this case by engagement of pivot pins 102 in apertures provided in the frame halves 90, 92. The pivot pins 102 allow pivoting of the latch assembly around an axis defined by the pins 102. Extending above the pins 102 is a latch 104 with a hooked head whilst below the pins 102 there is a semicircular lever arm 106. With the latch assembly 14 retained within the frame 4, the semi-circular lever arm 106 extends across the space between the frame halves 90, 92.

Connection of the two frame halves 90, 92 still further results in attachment of handle 6 through engagement of pins 108 in apertures 110 provided on the handle 6. The connection is such that the handle 6 can be rotated about an axis defined by the pins 108 relative the frame 4.

The handle 6 is provided with a handle pad 112 shown in FIG. 4 whilst the frame 4 is provided with a frame pad 114 shown in FIG. 6. These pads 112, 114 are formed with ribs to enhance gripping of a bottle neck as further discussed below.

The operation of the apparatus 2 will now be described with references to FIGS. 7A to 71. The initial position of the apparatus is shown in FIG. 7A. In this initial position the lever 8 is lowered and the pinions 44 are engaged with the upper ends of the racks 98. As a result the carrier 20 and so the corkscrew 16 are at their uppermost positions. It will be noted that in this position, the length of the corkscrew 16 is such that it is engaged in the screw passage 68 of the control nut 66. The pins 19 of the screwhead 18 are engaged in the recesses 34 of the carrier 20 by gravity and the corkscrew 16 is prevented from rotating. The teeth 80 of the control nut 66 are similarly engaged in the recesses of the lower control nut holder member 54 by gravity and so the control nut 66 is restrained against rotation. The latch 104 is positioned with its hooked end engaged with the upper face of flange 58*a* of the upper, control nut holder member 52 with the result that the control nut 66 is also restrained against longitudinal movement The apparatus 2 is then positioned on the neck of a bottle which is received between the lower end of the frame 4 and the handle 6 as shown in FIG. 7B. The frame 4 is grasped in the palm of the users hand and the handle 6 pivoted towards the frame by the fingers of the same hand. This brings the pads 112, 114 against the bottle neck to securely grip it and locates the cork 116 below the control nut assembly 12. The semi-circular lever arm 106 is engaged by the bottle neck Which causes it to rotate the latch 104 out of engagement with the upper control nut holder member 52 so releasing the control nut assembly 12 for longitudinal movement.

The lever 8 is rotated as shown in arrow 118 which brings the corkscrew 16 into engagement with the cork 116. This causes the screw head 18 to rise up in the cavity 26 of the carrier 20 so disengaging the pins 19 from the recesses 34 and bringing the ball bearing 42 into contact with the lower face of the retainer 38. The first restraint means are thereby released so making the corkscrew 16 free to rotate. Continued descent of the carrier 20 and so longitudinal movement of the corkscrew 16 with respect to the control nut assembly 12 causes rotation to be Imparted to the corkscrew 16 by virtue of its longitudinal movement within the screw passage 68 of the control nut 66.

As the lever 8 continues to be rotated, the corkscrew 16 therefore rotates and drives into the cork 116 until the pinions 44 reach the bottom of the racks 98. This position is shown in FIG. 7C.

Figure 7D:
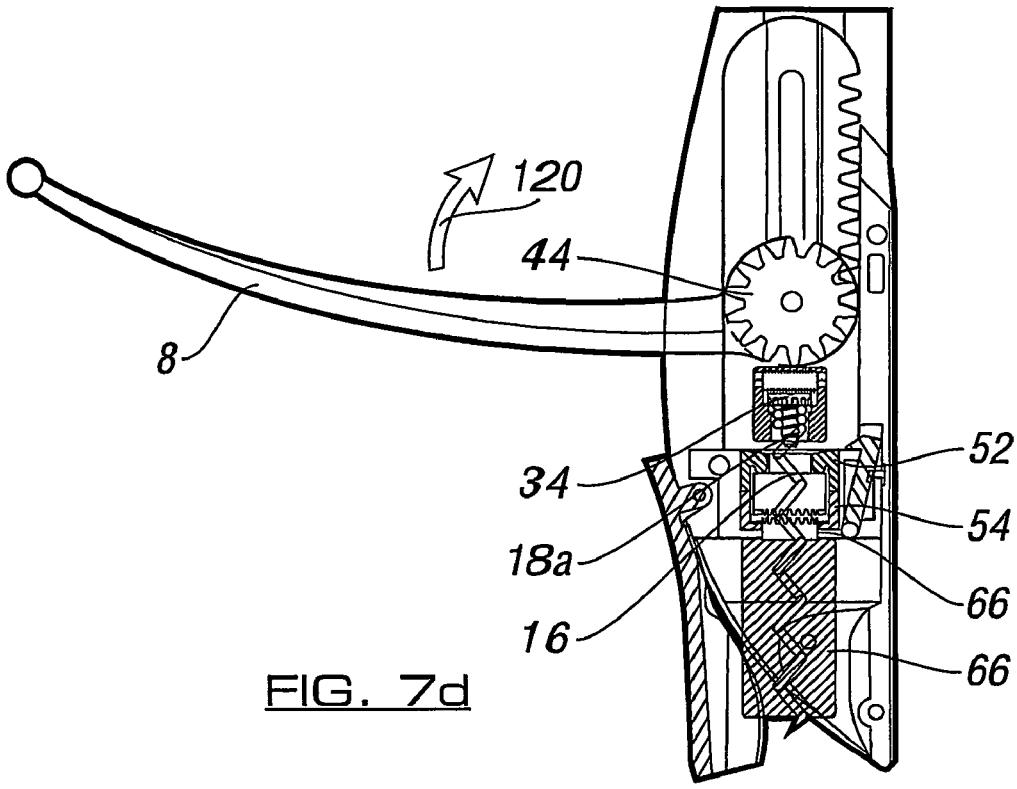
Figure 7E:
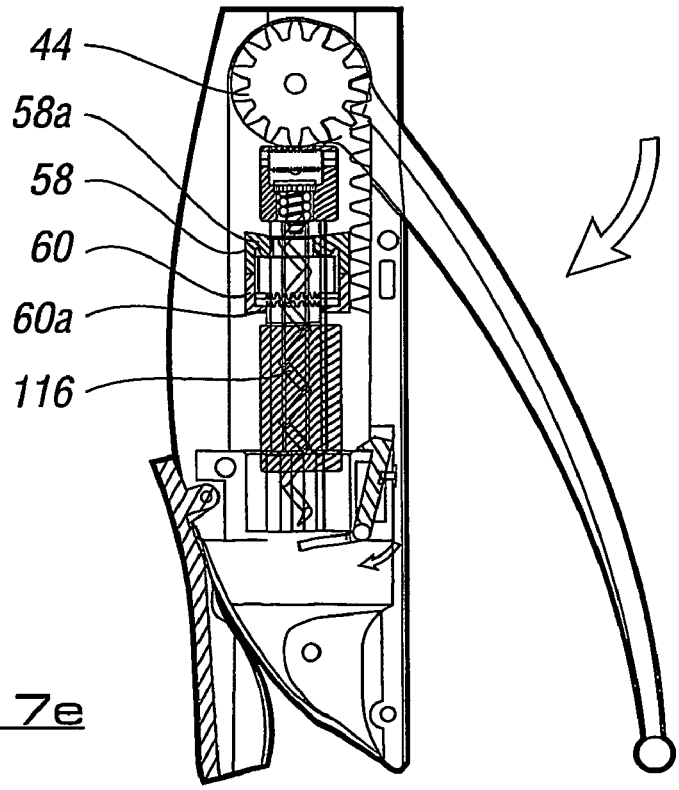

The lever 8 is then rotated in the opposite direction as shown by arrow 120 of FIG. 7D. There is no longer any upwards pressure on the screw head 18 and as a result the first restraint means re-engages so preventing rotation of the screw 16. The carrier 20 and corkscrew 1 arise upwardly as the pinions 44 rotate upwardly along the racks.98. The control nut assembly 12 also rises upwardly because it is unlatched and tapped between the carrier 20 and the cork 116. As a result there is no relative longitudinal movement between the corkscrew 16 and the screw passage 68 and so no rotational movement is imparted to the corkscrew 16 by the control nut 66. However, any possibility of the corkscrew rotating and thus backing out of the cork 116 is prevented by the positive engagement of the fist restraint means. Accordingly, it is ensured that the cork 116 will rise up with the corkscrew 16 and carrier 20 and so be pulled from the bottle.

Figure 7F:
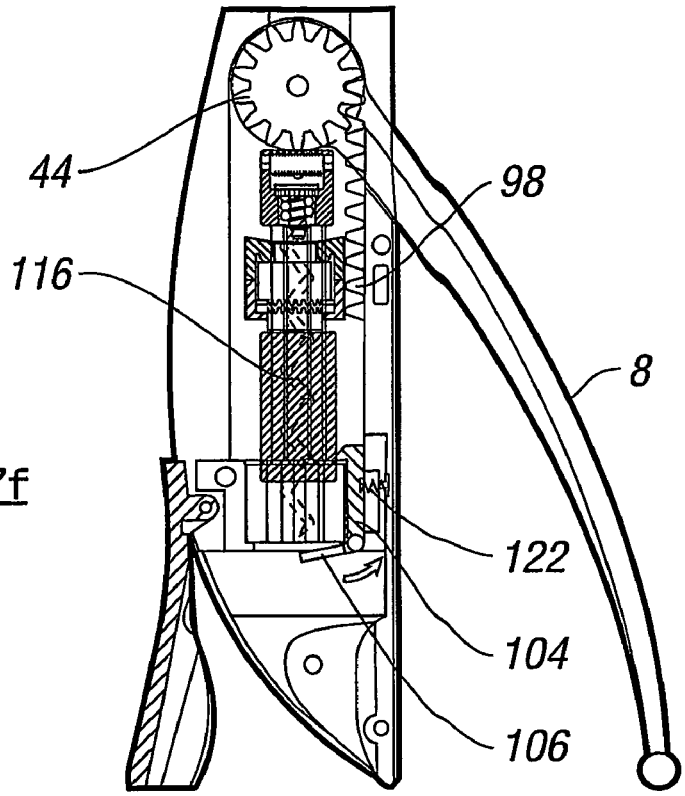

FIG. 7E shows the apparatus at the end of the extraction stroke of the lever 8 with the cork 116 held on the corkscrew 16 within the frame 4. The user can then release the grip on the handle 6 which pivots away from the bottle neck under pressure of spring 121 shown in FIG. 71. The apparatus 2 can be raised off the bottle. This removes the pressure on the semicircular lever arm 108 which frees the latch 104 to rotate back to its initial position under pressure of a spring 122, see FIG. 7F.

Figure 7G:
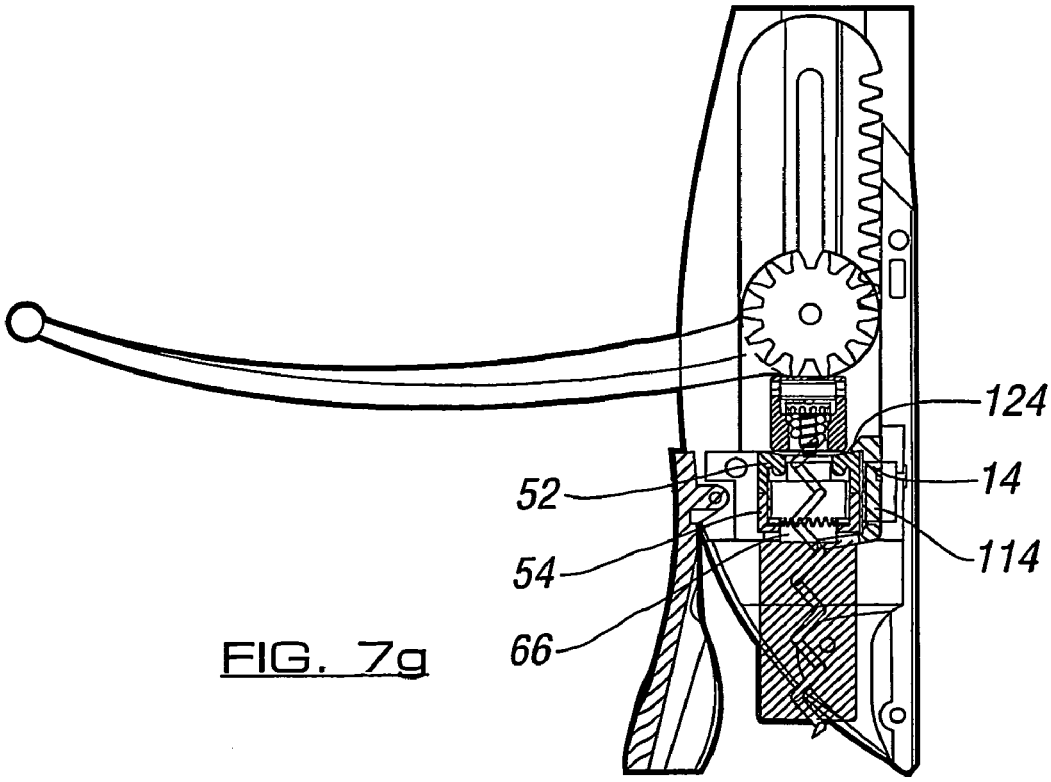

The lever 8 is then rotated once again to move it from the right to the left in the sense of the Figures. This causes the pinion 44 to descend the racks 98 which in turn moves the carder 20 and the control nut assembly 12 downwardly. The cork 116 remains impaled on the corkscrew 10 and so travels with the carrier 20 and the control nut assembly 12. The cork 110 passes the latch assembly 14 which is appropriately dimensioned for this purpose. The control nut assembly 12 then engages goes top of the latch assembly 14. As shown in FIG. 7G, the hooked head of the latch 104 is provided with a tapered leading face 124 which enables the control nut assembly 12 to pass below the latch 104 until the latch 104 re-engages with the upper face of the flange 58*a* of the upper control nut member 52. As a result the control nut holder assembly 12 is prevented from movement in the longitudinal direction by the latch assembly 14.

Figure 7H:
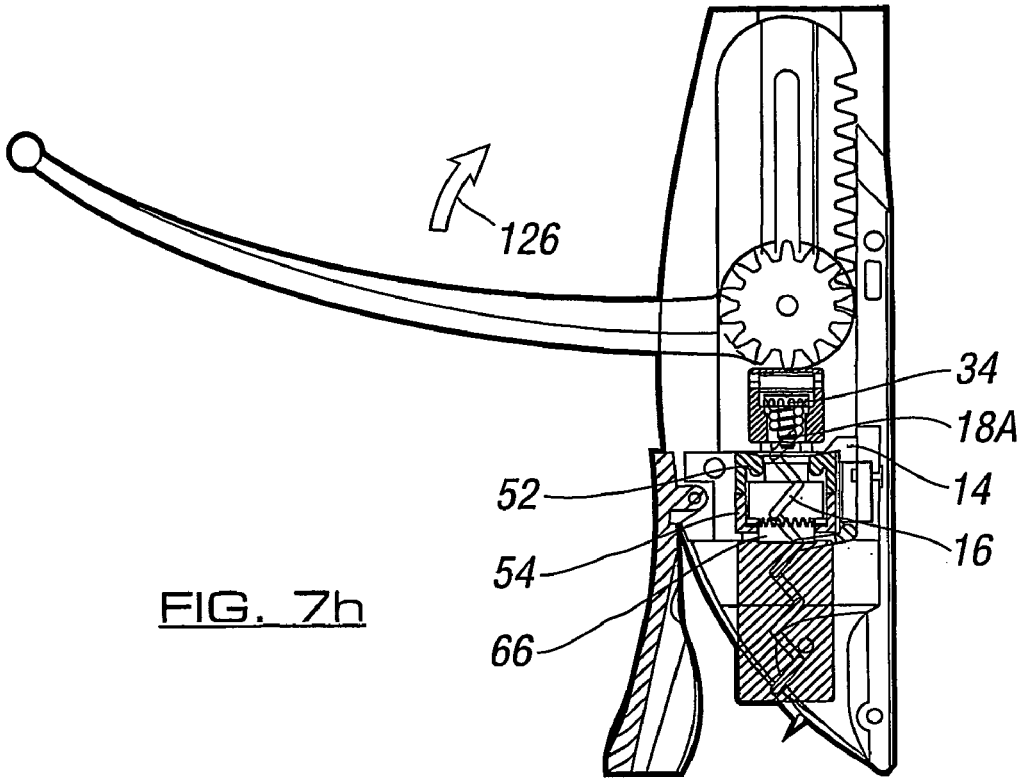

From this position which is illustrated in FIG. 7G, the lever 8 is re-rotated a second time from the: left to the right in a sense of the Figures as shown by arrow 126 in FIG. 7H. As the pinions 44 rise up, the racks 98, the carrier 20 rises with them. There is no upward pressure on the screw 16 and accordingly the first restraint means remains engaged and the screw 16 is prevented from rotation.

Since the control nut assembly 12 is latched by the latch assembly 14 and so prevented from upwards movement with the carrier 20, as the corkscrew 16 rises, it will raise the control nut 66 relative the control nut holder 52, 54 and as a result disengage the second restraint means. On further upwards movement of the corkscrew 16, the control nut will therefore rotate as the corkscrew 16 moves through the screw passage 68. The further upwards movement of the corkscrew 16 will also bring the cork 116 into contact with the lower region 74 of the control nut 66 and so into engagement with teeth 89. The cork 116: and control nut 66 will therefore be engaged and so the cork 116 will rotate with the control nut 6. There Is therefore no compression of the cork 116 such as to cause it to grip the corkscrew 18. As a result the cork 116 will be stripped from the corkscrew 16 and drop down out of the frame as depicted in FIG. 7I.

Figure 7I:
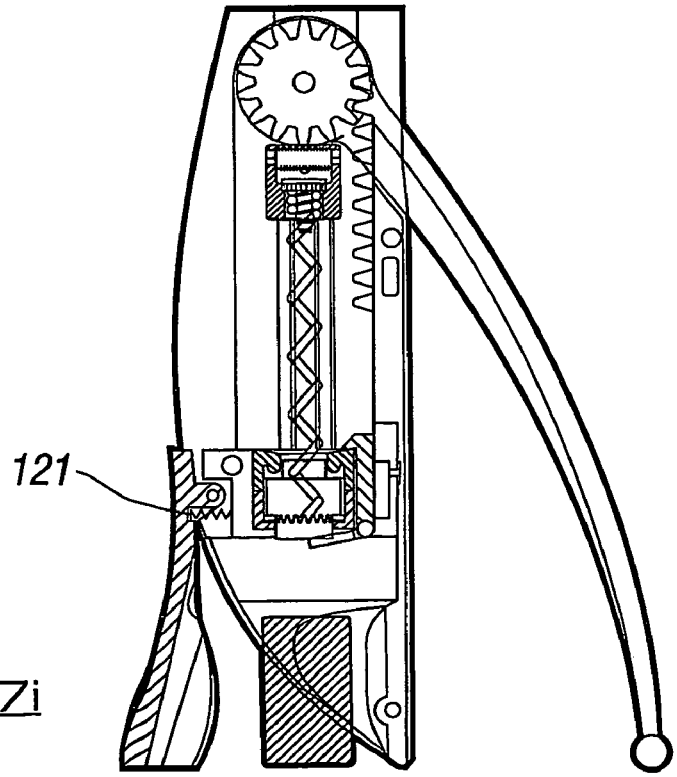

As will be appreciated from a comparison of FIGS. 7A and 7I, the apparatus 2 is then immediately ready for reuse. Unlike the cork extractor of British Patent 2053867, the apparatus 2 has the advantage that it does, not require a first step involving moving the parts from an initial position to a position in which the cork extractor can be engaged with a bottle nor, a final step of returning the parts to an initial position. Thus, in comparison with the cork extractor of British Patent 2053867, the apparatus 2 has a significant advantage in that it only requires four steps to both extract a cork and ship off the cork.

The apparatus 2 is robust and effective even though it has a relatively small number of parts. In particular, the use of a pinion and rack actuator makes the apparatus simple to use. However, by providing a fixed rack and a movable pinion, the movement is smoother and more ergonomic than the commercial embodiment of the cork extractor of British Patent 2053867. In addition, there is less friction between the actuator and the frame which reduces the effort required. The latch assembly 14 is also simple but effective. In addition, it allows the apparatus 2 to be held naturally by gripping of both the lower portion of the frame 4 and the handle 6 without any danger of accidental release of the latch because the latch operation is independent of the handle 6.

The first and second restraint means each function by positive engagement of two cooperating parts and therefore provide positive restraint on the corkscrew 16 and the screw nut assembly 12 when required during operation. The positive restraint provided by the first restraint means is particularly important since, as discussed above, it prevents the corkscrew from backing off the cork and ensures that the cork Is instead properly pulled.

Stripping the cork by holding the corkscrew stationary and rotating the screw guide 66 enables even synthetic corks to be removed from the apparatus without difficulty.

The apparatus 2 can be modified in a number of ways. Firstly, the lower control nut holder member 54, could be dispensed with and the recesses of the second restraint means instead provided on the frame 4. Secondly the actuator could take a different form such as, for example a pump type handle or an articulated lever.

Figure 8:
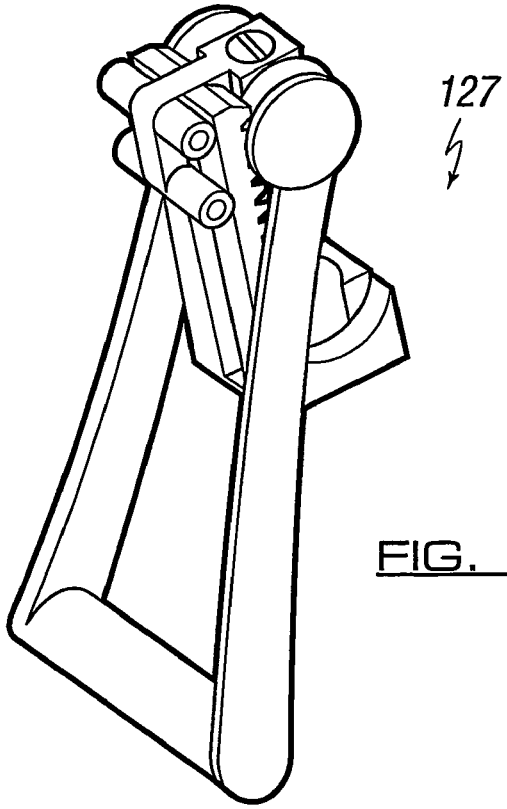
FIG. 8 is a prospective view illustrating an alternative fist assembly for use with an apparatus in accordance with the invention.
Figure 9:
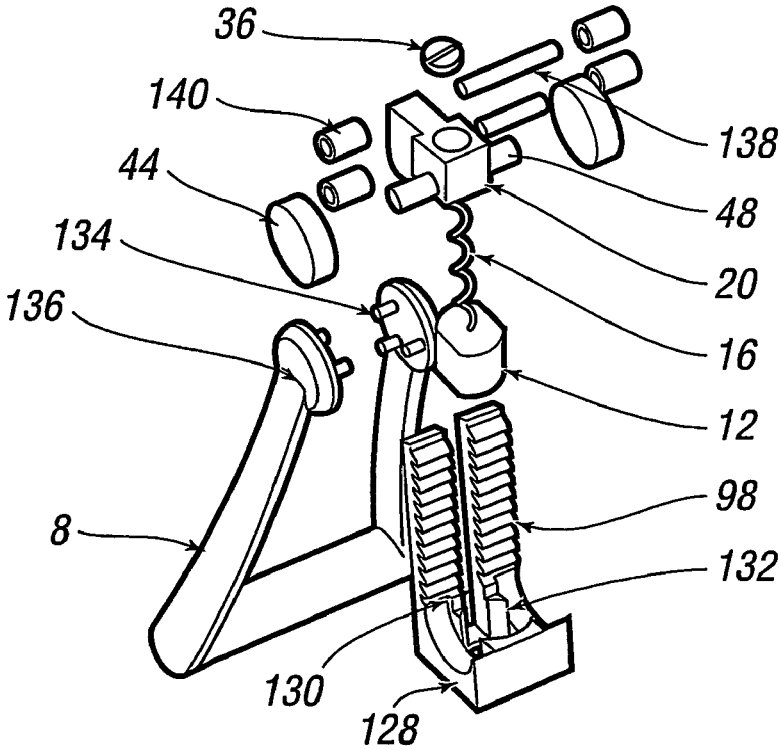
FIG. 9 is an exploded view of the parts of the assembly of FIG. 8.
Figure 10A:
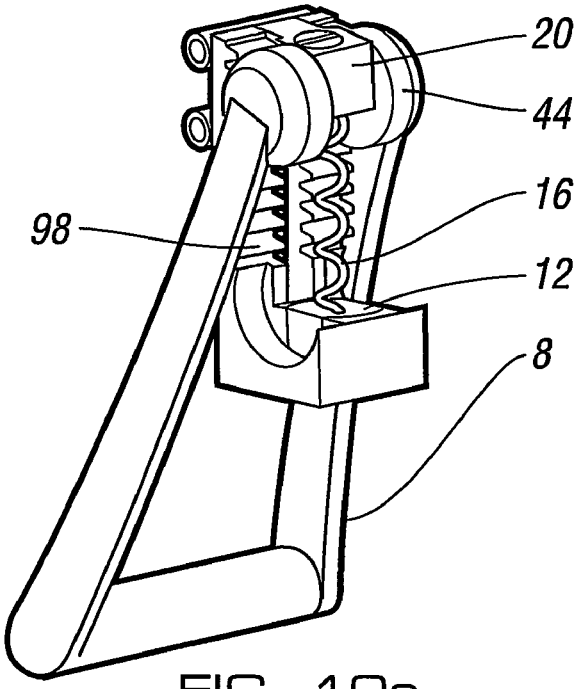
FIGS. 10A to 10I are prospective views illustrating the operation of the assembly of FIG. 8.
Figure 10B:
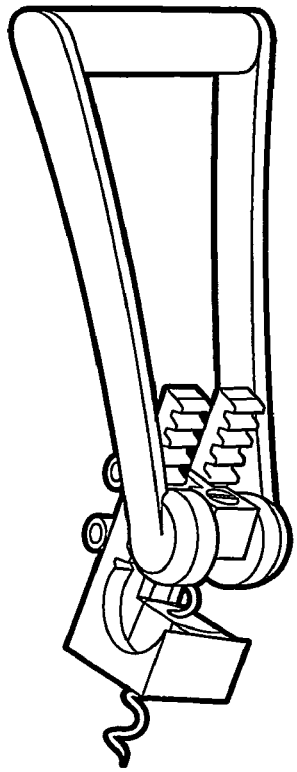
Figure 10C:
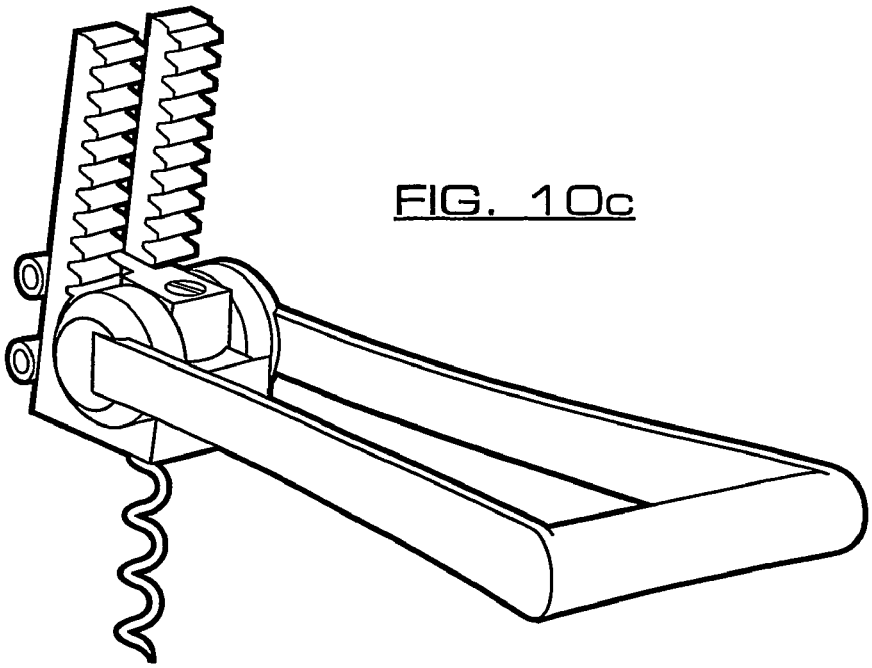
Figure 10D:
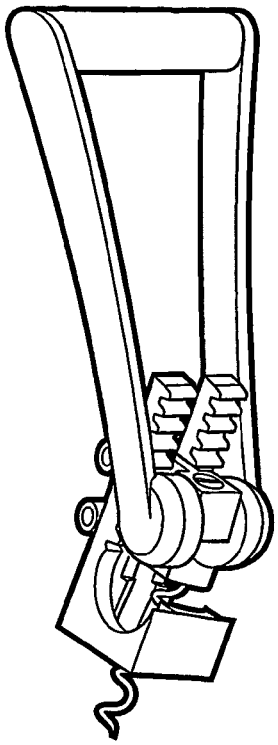
Figure 10E:
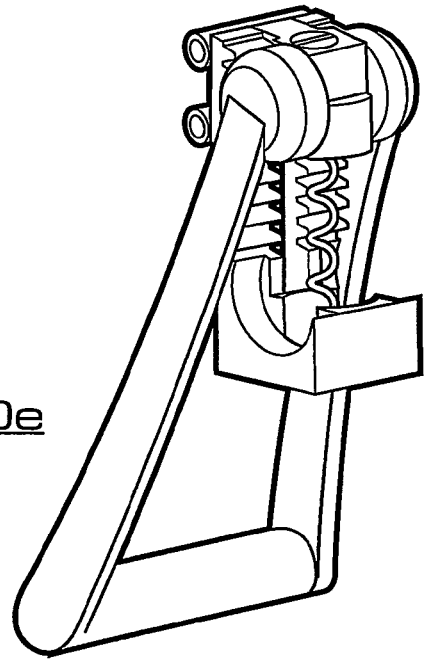
Figure 10F:
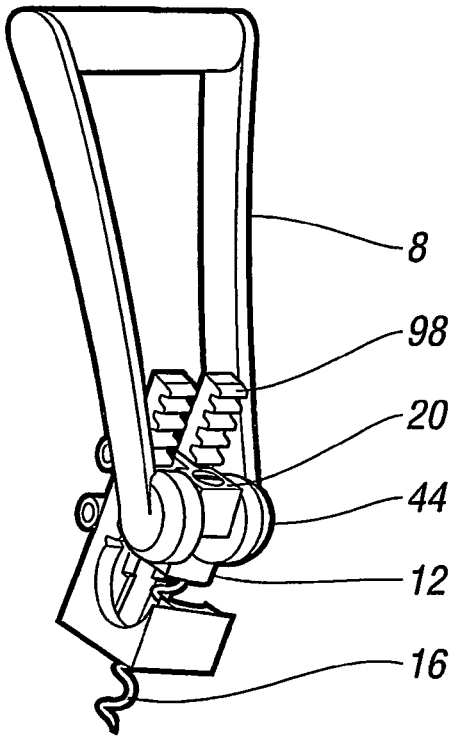
Figure 10H:
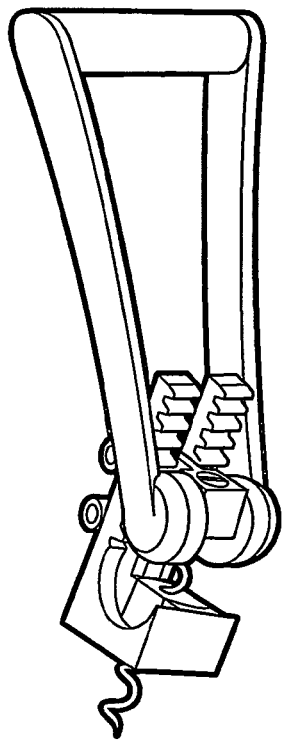
Figure 10G:
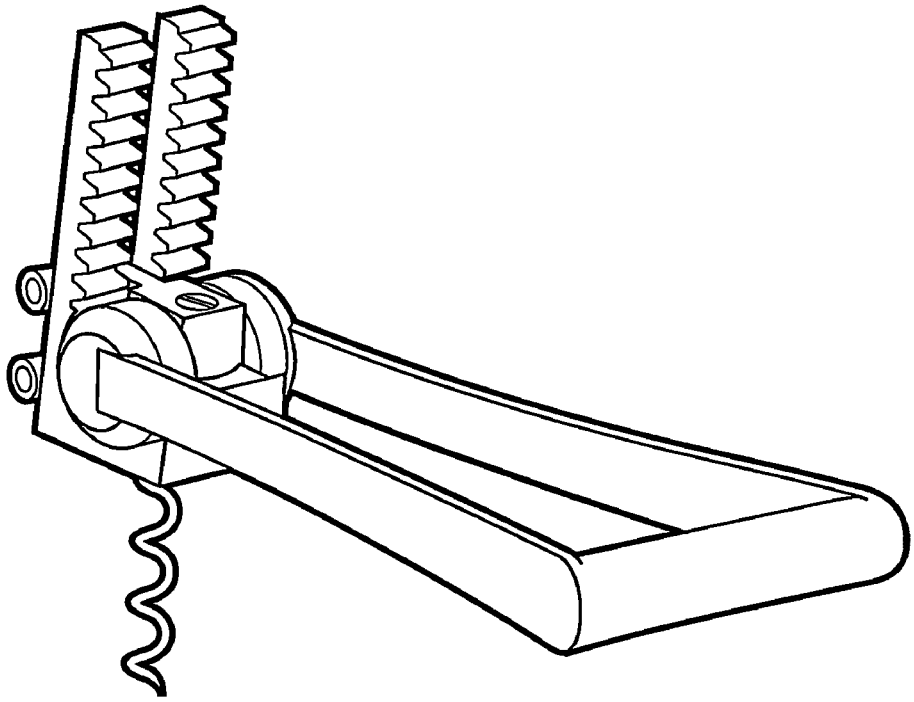
Figure 10I:
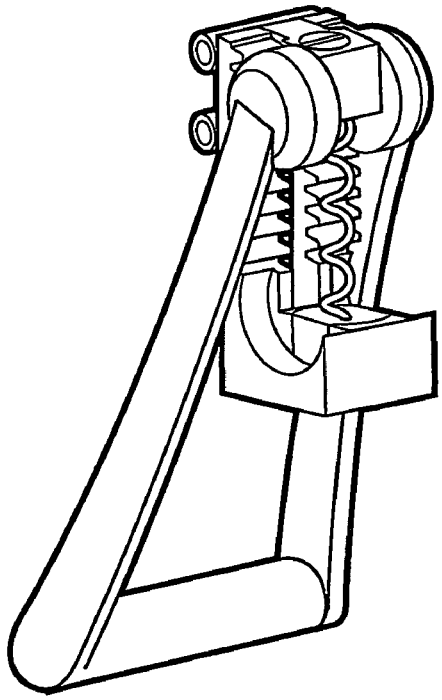

Another variation which can be made is illustrated in FIGS. 8 and 9. This shows an arrangement where the lever, actuator, carrier and control nut assembly are provided in a modular form. In describing this module 127, like parts will be referenced by like numerals.

The module 127 includes a body 128 having a generally L-shape. The leg is bifurcated and the racks 98 are formed on forks 130. The crosspiece has an upstanding end and it the end and the lower portions of the forks 130 are shaped to define two semicircular recesses 132.

The pinions 44 are mounted either side of the carrier 20, again by pins 48. On their outer faces, the pinions 44 are shaped to receive mounting pins 134 provided on the inner faces of two generally circular end pieces 136 of the lever 8 which in this embodiment is generally U-shaped.

To assemble the module the racks 98 are engaged with the pinions 44 whilst the control nut assembly 12 is seated in the semicircular recesses 132. The module is then mounted to a frame (not shown) by pins 138 which are received in bosses 140 of the frame.

The operation of the module Is illustrated in FIGS. 10A to 10I, each of which corresponds to FIGS. 7A to 7I as regards the operational state.

The latch assembly 14 can also be provided on the module.

The invention claimed is:

1. Apparatus for extracting a cork from a bottle comprising, a corkscrew mounted in a carrier, the carrier being mounted on a frame for longitudinal reciprocating movement with respect to the longitudinal axis of the corkscrew and the corkscrew being rotatably mounted on the carrier for joint longitudinal movement therewith, the axis of rotation of the corkscrew being generally coincident with the centre line of the corkscrew, a control nut rotatably mounted on the frame, the control nut having a screw passage therethrough, the screw passage being positioned to receive the corkscrew and configured to mate with the configuration of the corkscrew whereby, upon longitudinal movement of the corkscrew in the screw passage, rotational movement is imparted to the corkscrew, an actuator operatively connected to the carrier for reciprocating the carrier, a first restraint member independent of the control nut which restrains rotation of the corkscrew with respect to the carrier, a second restraint member which restrains rotation of the control nut with respect to the frame, and a latch which releasably latches the control nut to the frame to restrain relative movement therebetween in the longitudinal direction with respect to the longitudinal axis of the corkscrew, wherein, the first and/or second restraint members includes a detent on the part whose rotation is to be restrained and a recess for receiving the detent when rotation of the part is to be restrained.

2. Apparatus as claimed in claim 1, wherein, the first restraint member includes at least one detent carried by the corkscrew and a cooperating recess provided in the carrier.

3. Apparatus as claimed in claim 2, wherein, the corkscrew has a screw head by which it is mounted in the carrier and the detent is provided on the screw head.

4. Apparatus as claimed in claim 3, wherein, the carrier defines a chamber for receiving the screw head, the chamber including an upper wall, a lower wall and an aperture in the lower wall through which the corkscrew extends and is sized to allow restricted movement of the screw head therein in the longitudinal direction, the recess is defined in the lower wall adjacent the aperture, and a bearing is held between the upper wall and the screw head.

5. Apparatus as claimed in claim 1, wherein, the second restraint member comprises at least one detent carried by the control nut and a cooperating recess.

6. Apparatus as claimed in claim 5, wherein, the recess of the second restraint member is provided in the frame or in a control nut holder fixed to the frame.

7. Apparatus as claimed in claim 1, wherein, the first and/or second restraint member includes a plurality of recesses arranged generally in a circle.

8. Apparatus as claimed in claim 1, further, including a holder for the control nut arranged to allow restricted movement of the control nut with respect thereto in the longitudinal direction between an upper position in which the control nut can rotate relative the frame and a lower position in which rotation of the control nut is restrained by the second restraint member.

9. Apparatus as claimed in claim 1, further comprising a holder for the control nut arranged to allow limited tilting of the control nut.

10. Apparatus as claimed in claim 8, wherein the control nut holder comprises two members which, when engaged, define a chamber for receiving part of the control nut.

11. Apparatus as claimed in claim 1, wherein the actuator comprises a rack secured to the frame and a pinion engaged with the rack and movable relative to the rack and the frame, the carrier being mounted on the frame via the pinion and rack.

12. Apparatus as claimed in claim 11, wherein the actuator further comprises a lever for rotating the pinion to cause movement of the pinion relative to the rack.

13. Apparatus as claimed in claim 1, wherein the latch includes a detent mounted, to enable movement between a first, latching, position and a second, release position and bottle-engaging member which, when engaged by a bottle, causes movement of the latch from the first position to the second position.

14. Apparatus as claimed in claim 13, wherein the bottle-engaging member includes a lever engagable with a bottle neck, the lever connected to the detent such that, on engagement with the bottle neck, the lever causes pivoting of the detent.

15. Apparatus as claimed in claim 1, wherein the frame includes a sleeve extending in the longitudinal direction and enclosing the corkscrew, the carrier, the control nut and the latch.

16. Apparatus as claimed in claim 9, wherein the control nut holder comprises two members which, when engaged, define a chamber for reviewing part of the control nut.

* * * * *